US007121880B2

(12) United States Patent
Sasaki et al.

(10) Patent No.: US 7,121,880 B2
(45) Date of Patent: Oct. 17, 2006

(54) SURFACE-MOUNTED CONNECTOR

(75) Inventors: Harehide Sasaki, Aichi-ken (JP); Reiki Okamoto, Aichi-ken (JP); Yoshiaki Kato, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 0 days.

(21) Appl. No.: 11/175,381

(22) Filed: Jul. 7, 2005

(65) Prior Publication Data

US 2006/0009091 A1 Jan. 12, 2006

(30) Foreign Application Priority Data

Jul. 12, 2004 (JP) ..... 2004-204236

(51) Int. Cl.
*H01R 13/73* (2006.01)

(52) U.S. Cl. ..... 439/566; 439/570

(58) Field of Classification Search ..... 439/566, 439/570

See application file for complete search history.

(56) References Cited

U.S. PATENT DOCUMENTS 5,120,256 A * 6/1992 Walden ..... 439/553
5,194,017 A * 3/1993 Consoli ..... 439/492
5,395,265 A * 3/1995 DiMondi et al. ..... 439/553
5,445,529 A * 8/1995 Yamamoto ..... 439/660
5,704,807 A * 1/1998 Sherman et al. ..... 439/570
5,931,689 A * 8/1999 Patel ..... 439/346
6,254,429 B1 * 7/2001 Morita ..... 439/570
6,645,005 B1 * 11/2003 Wu ..... 439/563

FOREIGN PATENT DOCUMENTS

JP 5-23429 3/1993

* cited by examiner

*Primary Examiner*—Tho D. Ta
(74) *Attorney, Agent, or Firm*—Thomas W. Cole; Nixon Peabody LLP

(57) ABSTRACT

In order to prevent a fixing terminal from being dislocated from regular-mounting-position on a connector main body when force is applied from outside before placed on a substrate, a surface-mounted connector including a connector main body to be placed on a substrate, a fixing terminal that is temporarily fixed to a side wall of the connector main body by being press-fitted, along the side wall, from a side opposite to that in which the connector main body is placed on the substrate, and that, in the temporarily fixed state, is soldered to the substrate, thereby allowing the connector main body to be mounted on the substrate, and shielding walls provided integrally with the connector main body alongside the fixing terminal in the temporarily fixed state so as to correspond to the fixing terminal, and preventing the fixing terminal in the temporarily fixed state from being interfered from outside, is provided.

12 Claims, 3 Drawing Sheets

SURFACE-MOUNTED CONNECTOR

CROSS-REFERENCE TO RELATED APPLICATION

This application claims priority under 35 USC 119 from Japanese Patent Application No. 2004-204236, the disclosure of which is incorporated by reference herein.

BACKGROUND OF THE INVENTION

1. Field of the Invention

The present invention relates to a surface-mounted connector in which terminals projecting from a connector main body is soldered to a substrate in a state of being placed on the substrate.

2. Description of the Related Art

On a substrate of an electronic device or an electronic circuit, for example, a connector and the like are mounted as electronic components. When the connector is mounted on the substrate, for example, the connector is fixed to the substrate in such a manner as to be fastened to the substrate with screws.

Here, a surface-mounted connector that is one type of connector (which may occasionally be referred as an SMT connector) is provided with a connector main body formed into a substantially rectangular box, and a screw fastening flange portion formed so as to project from a side of the connector main body. With the screw fastening flange portion being fastened to the substrate by inserting screw(s) through the flange portion, the connector main body, that is to say, an SMT connector is fixed to the substrate.

However, the screw fastening flange portion of the SMT connector occupies a relatively large size (area) on the substrate, and therefore, the large occupying area becomes an obstacle in producing small-sized electronic devices or electronic circuits.

In this case, there exists a structure in which the SMT connector is mounted on the substrate by soldering fixing terminal, provided on the SMT connector, to the substrate instead of using the screw fastening. The fixing terminal is formed as, for example, a member that is bent so as to have a substantially L-shaped cross section. The fixing terminal is temporarily fixed to the connector main body in such a manner as to be press-fitted, along a side wall of the connector main body, from a side that is opposite to a side in which the connector main body is mounted on the substrate. In the temporarily fixed state, the bent portion is made to face the substrate when the SMT connector is mounted on the substrate (for example, see Japanese Utility Model Application Laid-Open (JP-U) No. 5-23429). With the fixing terminal being soldered to the substrate, the connector main body, that is to say, the SMT connector itself is mounted on the substrate. Here, even if the bent portion of the fixing terminal is made smaller than the above-described screw fastening flange portion, to some degree, in the area occupied on the substrate, a sufficient soldering strength is obtained. For this reason, an electronic device or electronic circuit can be made smaller.

However, if excessive force is applied to the fixing terminal for some reason (for example, when the SMT connector is placed on the substrate, the SMT connector is bumped against other electronic components mounted or placed on the substrate) during a time period from a time in which the fixing terminal is press-fitted into the connector main body and brought into a temporarily fixed state until a time in which the SMT connector is placed on the substrate, and further until a time in which the SMT connector is mounted on the substrate, the fixing terminal is dislocated from a regular mounting position on the connector main body. As a result, the fixing terminal is removed from the connector main body or is placed on the substrate in the state of being raised (separated) from the substrate, and there is a possibility that mounting failure of the connector main body may occur.

SUMMARY OF THE INVENTION

In view of the above-described problems, the present invention provides a surface-mounted connector that can prevent a fixing terminal from being dislocated from a regular mounting position on a connector main body when excessive force is applied from outside before mounted on a substrate, and that makes it possible to reliably mount, on the surface of the substrate, the connector main body placed on the substrate.

According to a first aspect of the present invention, there is provided a surface-mounted connector which includes: a connector main body formed into a substantially rectangular box and to be placed on a substrate; a fixing terminal that is temporarily fixed to a side wall of the connector main body by being press-fitted, along the side wall, from a side opposite to that in which the connector main body is placed on the substrate, and that, in the temporarily fixed state, is soldered to the substrate, thereby allowing the connector main body to be mounted on the substrate; and shielding walls provided integrally with the connector main body alongside the fixing terminal in the temporarily fixed state so as to correspond to the fixing terminal, and preventing the fixing terminal in the temporarily fixed state from being interfered from outside.

In the surface-mounted connector according to the first aspect of the present invention, the fixing terminal is press-fitted from a side opposite to a side in which a connector main body formed into a substantially rectangular box is placed on the substrate, along the side wall of the connector main body, and is temporarily fixed to the connector main body. In the state in which the fixing terminal is temporarily fixed to the connector main body as described above, the connector main body and the fixing terminal are placed on the substrate. Further, when the fixing terminal is soldered to the substrate, the connector main body is mounted on the substrate. That is to say, the surface-mounted connector is mounted on the substrate.

Here, in the surface-mounted connector according to the first aspect of the present invention, even if excessive force is applied from outside for some reason during a time period from a time in which the fixing terminal is press-fitted into the connector main body and is brought into a temporarily fixed state until a tome in which the connector main body and the fixing terminal are placed on the substrate, and further until a time in which the connector main body is mounted on the substrate, the fixing terminal is prevented from being interfered from outside due to the shielding walls that are formed integrally with the connector main body in the vicinity of the fixing terminal so as to correspond to the fixing terminal. As a result, there is no possibility that the fixing terminal may be dislocated from a regular mounting position on the connector main body. That is to say, the surface-mounted connector of the present invention makes it possible to prevent the fixing terminal from being removed from the connector main body or prevent the fixing terminal from being placed on the substrate in the state of being raised (separated) from the substrate. Accordingly, when the fixing terminal is soldered to the substrate, the connector main body can be reliably mounted on the surface of the substrate.

According to a second aspect of the present invention, there is provided a surface-mounted connector which includes: a connector main body formed into a substantially rectangular box and to be placed on a substrate; fixing terminals each including an engaging portion and a soldering portion that is bent substantially perpendicular to the engaging portion and soldered to the substrate, each of the fixing terminals being temporarily fixed to respective side walls of the connector main body by each engaging portion being press-fitted, along the respective side walls, from a side opposite to that in which the connector main body is placed on the substrate, and, in the temporarily fixed state, each soldering portion being soldered to the substrate, thereby allowing the connector main body to be mounted on the substrate; and first shielding walls and second shielding walls provided integrally with the connector main body alongside the respective fixing terminals in the temporarily fixed state so as to correspond to the respective fixing terminals, and preventing the respective fixing terminals in the temporarily fixed state from being interfered from outside, wherein, at each of the side walls, the first shielding wall and the second shielding wall extend in a direction substantially perpendicular to the side wall, and in the temporarily fixed state, the soldering portion extends in a direction substantially perpendicular to the side wall, and the first shielding wall and the second shielding wall extend from the side wall or from the vicinity of the side wall such that the soldering portion is interposed therebetween.

In the surface-mounted connector according to the second aspect of the present invention, in the same manner as in the first aspect of the present invention, the fixing terminals are press-fitted from a side opposite to a side in which a connector main body formed into a substantially rectangular box, along each side wall of the connector main body, and are temporarily fixed to the connector main body. In the state in which the fixing terminals are temporarily fixed to the connector main body as described above, the connector main body and the fixing terminals are placed on the substrate. Further, when the fixing terminals are soldered to the substrate, the connector main body is mounted on the substrate. That is to say, the surface-mounted connector is mounted on the substrate.

Here, in the surface-mounted connector according to the second aspect of the present invention, even if excessive force is applied from outside for some reason during a time period from a time in which each fixing terminal is press-fitted into the connector main body and is brought into a temporarily fixed state until a tome in which the connector main body and each fixing terminal are placed on the substrate, and further until a time in which the connector main body is mounted on the substrate, each fixing terminal is prevented from being interfered from outside due to the first shielding walls and the second shielding walls, which are formed integrally with the connector main body in the vicinity of the respective fixing terminals so as to correspond to the respective fixing terminals. The first shielding walls and the second shielding walls each extend in a direction substantially perpendicular to the respective side walls, and the soldering portions of the fixing terminals in the temporarily fixed state extend in the direction substantially perpendicular to the respective side walls. The first shielding walls and the second shielding walls extend from each side wall or from the vicinity thereof so that each soldering portion is interposed therebetween. As a result, there is no possibility that each fixing terminal may be dislocated from the regular mounting position on the connector main body. That is to say, the surface-mounted connector of the present invention makes it possible to prevent the fixing terminals from being removed from the connector main body or prevent the fixing terminals from being placed on the substrate in the state of being raised from the substrate. Accordingly, when the fixing terminals are soldered to the substrate, the connector main body can be reliably mounted on the surface of the substrate.

Further, in the surface-mounted connector according to the first aspect of the present invention, preferably, the fixing terminal includes an engaging portion that is engaged and temporarily fixed at a predetermined position on the side wall, and a soldering portion that is bent substantially perpendicular to the engaging portion and soldered to the substrate; and dimension of the shielding wall in a direction perpendicular to the substrate is greater than a plate thickness of the soldering portion.

Moreover, in the surface-mounted connector according to the first aspect of the present invention, preferably, the fixing terminal includes an engaging portion that is engaged and temporarily fixed at a predetermined position on the side wall, and a soldering portion that is bent substantially perpendicular to the engaging portion and soldered to the substrate; the shielding wall extends in a direction substantially perpendicular to the side wall, and in the temporarily fixed state, the soldering portion extends in a direction substantially perpendicular to the side wall; and in the temporarily fixed state, a distal end of the shielding wall in a direction it extends is located further at an outer side than a distal end of the soldering portion in a direction it extends.

Still further, in the surface-mounted connector according to the first aspect of the present invention, preferably, the fixing terminal includes an engaging portion that is engaged and temporarily fixed at a predetermined position on the side wall, and a soldering portion that is bent substantially perpendicular to the engaging portion and soldered to the substrate; the shielding walls comprise a first shielding wall and a second shielding wall; and the first shielding wall and the second shielding wall extend from the side wall or from the vicinity thereof such that the soldering portion is interposed therebetween.

In the surface-mounted connector according to the second aspect of the present invention, preferably, dimension of each of the first and second shielding walls in a direction perpendicular to the substrate is greater than a plate thickness of the soldering portion.

Further, in the surface-mounted connector according to the second aspect of the present invention, preferably, in the temporarily fixed state, respective distal ends of the first and second shielding walls in a direction in which the first and second shielding walls extend is located further at an outer side than a distal end of the soldering portion in a direction in which it extends.

As described above, the surface-mounted connector according to the present invention makes it possible to prevent a fixing terminal from being dislocated from a regular mounting position on a connector main body when excessive force is applied from outside before mounted on a substrate, and further, reliably mount the connector main body placed on the substrate, on the surface of the substrate.

BRIEF DESCRIPTION OF THE DRAWINGS

Embodiments of the invention will be described in detail with reference to the following figures, wherein:

FIG. 2A is a plan view, FIG. 2B is a front view, and FIG. 2C is a left side view;

DETAILED DESCRIPTION OF THE INVENTION

A surface-mounted connector (which may occasionally be referred as an SMT connector) 10 according to an embodiment of the present invention will now be described with reference to FIGS. 1, 2A, 2B, 2C and 3. For convenience of explanation, note that, in these drawings, a direction indicated by arrow A denotes the front, a direction indicated by arrow B and orthogonal to the direction indicated by arrow A denotes the right side, and a direction indicated by arrow C and orthogonal to both the directions indicated by arrow A and arrow B denotes the upper side.

Figure 1:
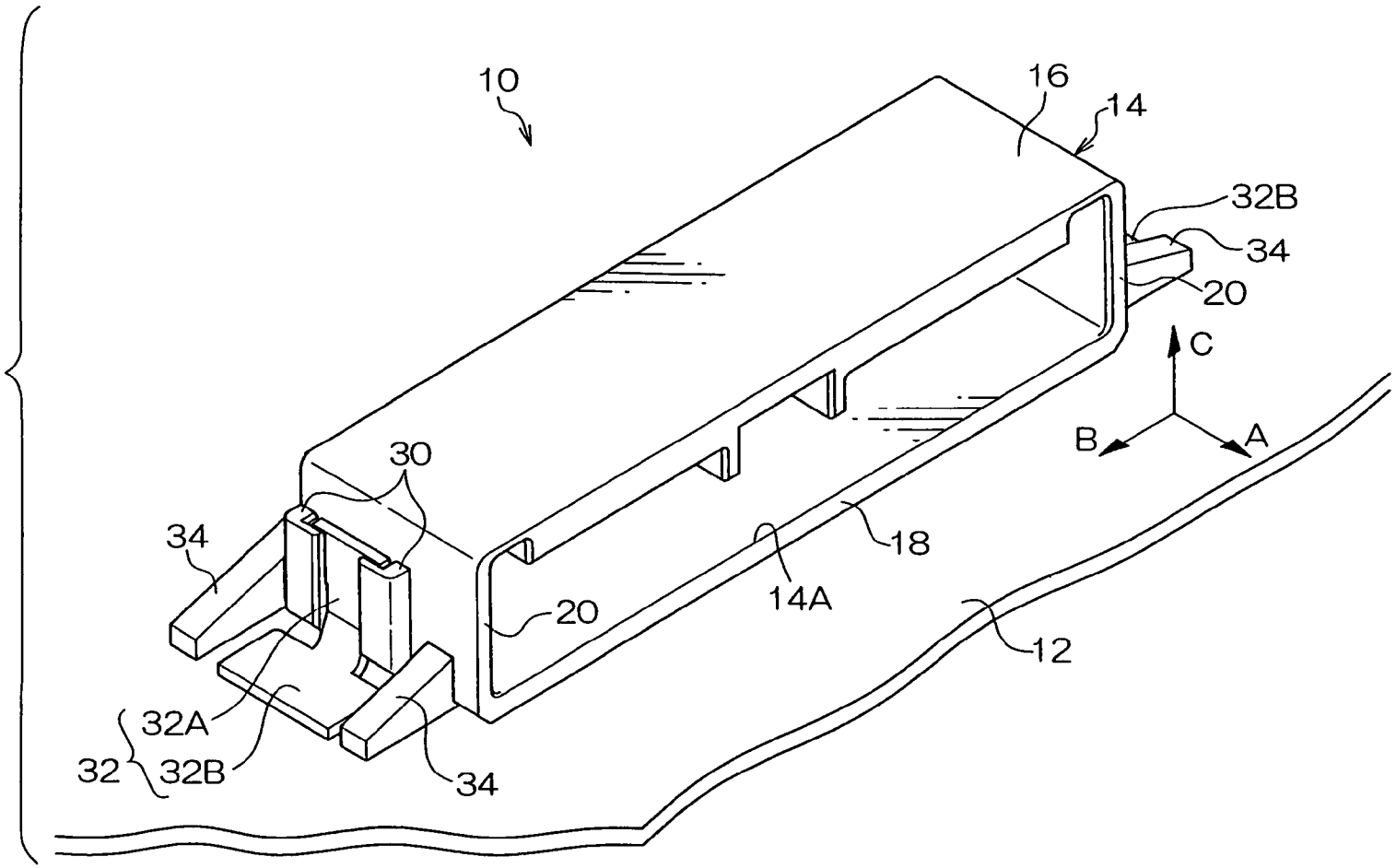
FIG. 1 is a perspective view showing a state in which a surface-mounted connector according to an embodiment of the present invention is mounted on a substrate.

FIG. 1 shows schematically a perspective illustration of the SMT connector 10, and a substrate (a printed circuit board on which a land is printed by, for example, screen printing or the like) 12 on which the SMT connector 10 is mounted.

The SMT connector 10 includes a connector main body 14 formed into a substantially rectangular box having an opening portion 14A at the front thereof. The upper and lower edges, and the right and left edges of the opening portion 14A are defined by a top plate 16, a bottom plate 18, and a pair of side plates 20 (left and right). The top plate 16, the bottom plate 18, and the pair of side plates 20 are connected together by a backside wall 22 (shown in FIGS. 2A, 2B and 2C) at a rear end at the opposite side of the opening portion 14A. As a result, the connector main body 14 is formed substantially into a rectangular box, as described above.

Figure 2A:
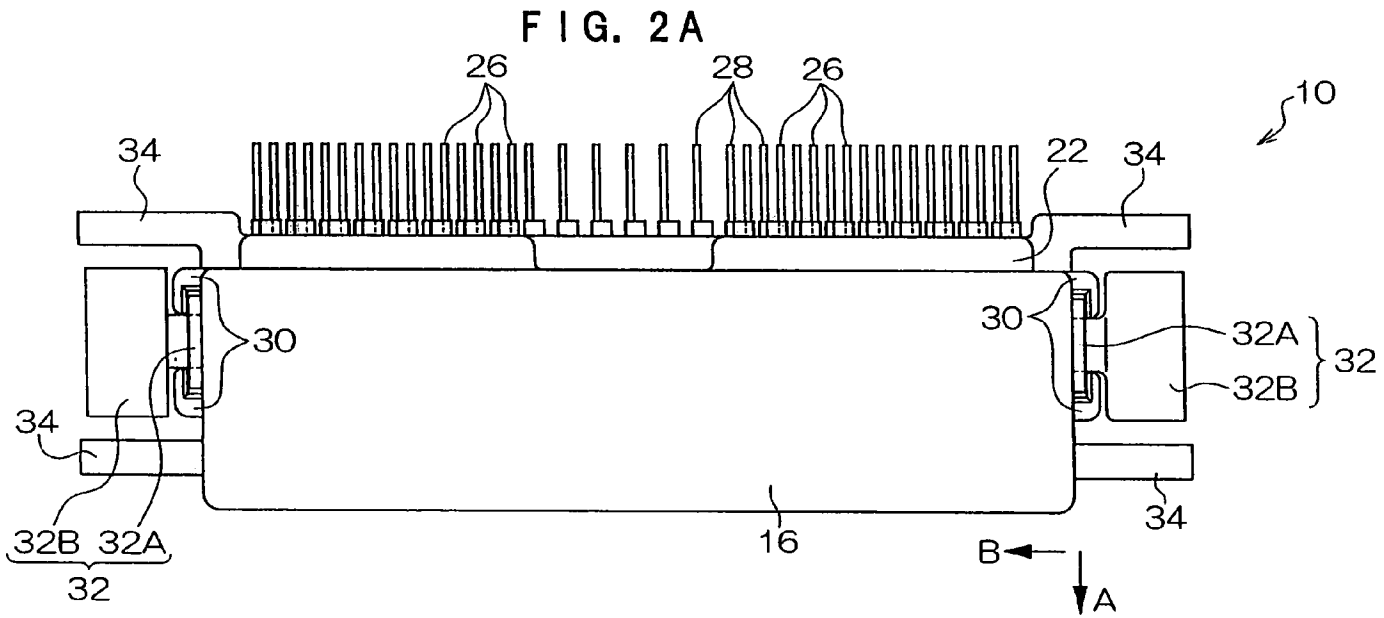
FIGS. 2A, 2B and 2C are diagrams each showing a surface-mounted connector according to an embodiment of the present invention.
Figure 2B:
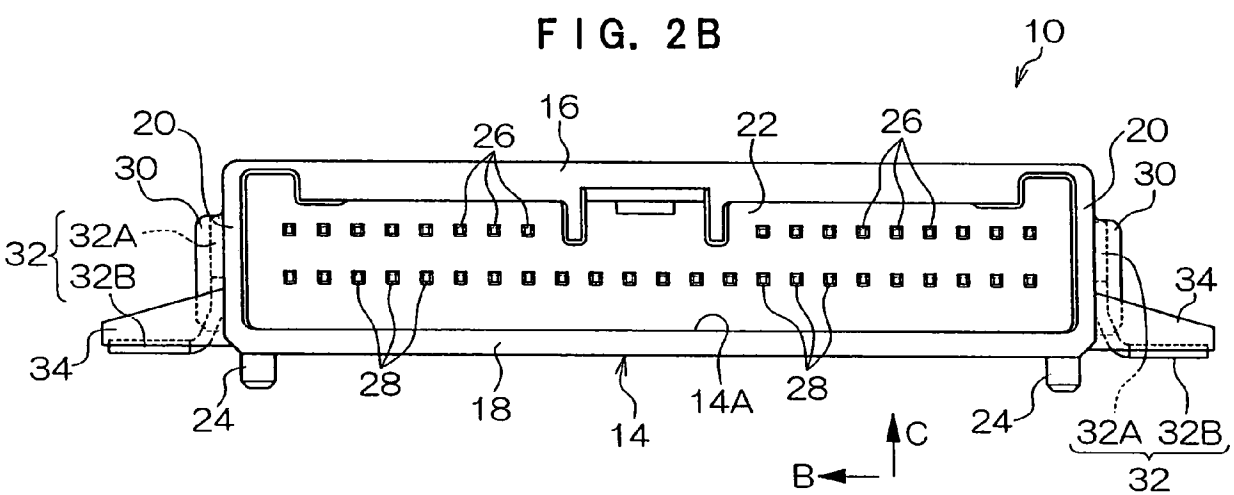
Figure 2C:
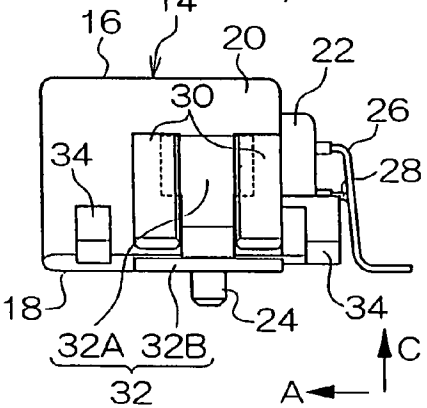
Figure 3:
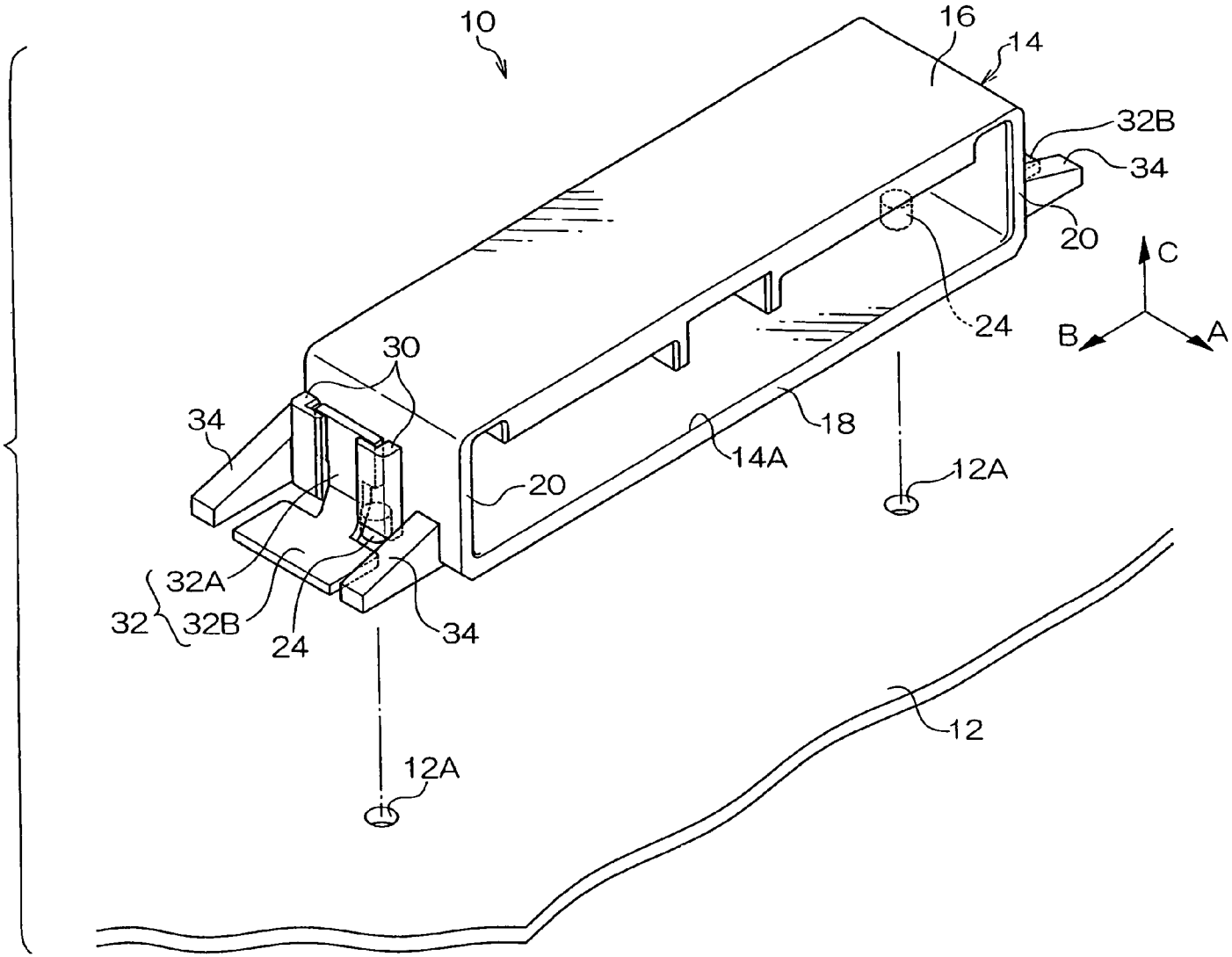
FIG. 3 is an exploded perspective view showing a surface-mounted connector according to an embodiment of the present invention, and a substrate.

Further, as shown in FIGS. 2B, 2C and 3, the bottom plate 18 is provided with positioning projections 24 which are each formed so as to project downward. In the present embodiment, two projections 24 are provided and are each formed into a short cylindrical configuration. These positioning projections 24 are adapted to position the SMT connector 10 on the substrate 12 by being inserted in or passing through positioning holes 12A (see FIG. 3) formed on the substrate 12. Accordingly, the SMT connector 10 in which the positioning projections 24 are inserted in or pass through the positioning holes 12A of the substrate 12 is not allowed to slide and rotate with respect to the substrate 12.

Further, as shown in FIG. 1 through FIG. 3, the side walls 20 of the connector main body 14 each include a fixing terminal holder 30. Each of the fixing terminal holders 30 is provided in such a manner that a pair of engaging pieces, which are arranged apart from each other in the side wall 20 along the front-to-back direction, extend from the side wall 20 to the outside in the rightward or leftward direction (to the opposite side with respect to the associated side wall 20) and are formed integrally with the associated side wall 20. Further, at each of the fixing terminal holders 30, a notch corresponding to a fixing terminal 32 (described later) is each provided in a portion of the fixing terminal holder 30, which portion is from the vertical-direction intermediate portion to the upper end and at a side in which the pair of engaging members face each other. In the fixing terminal holder 30, respective distal ends of the engaging pieces are bent in the front-to-back direction so as to face each other (to have a substantially L-shaped configuration) when viewed from the top. Each of the fixing terminal holder 30 includes steps (stepped portion) in the vertical-direction intermediate portion thereof, and the stepped portion defines a regular mounting position at which the fixing terminal 32 is to be mounted (see FIGS. 2A, 2B, 2C and FIG. 3).

The fixing terminal 32 is mounted to the fixing terminal holder 30 as described above. The fixing terminal 32 includes an engaging portion 32A and a soldering portion 32B.

The engaging portion 32A of the fixing terminal 32 corresponds to the above-described notches of the fixing terminal holder 30. With the engaging portion 32A being press-fitted into the notches from the upper side, the fixing terminal 32 is held in the fixing terminal holder 30. When the engaging portion 32A is engaged with the above-described stepped portion of the fixing terminal holder 30, the fixing terminal 32 is brought into a temporarily fixed state at the regular mounting position on the connector main body 14, and movement of the fixing terminal 32, not including upward movement, is restricted by the fixing terminal holder 30.

The soldering portion 32B of the fixing terminal 32 is formed so as to be bent substantially at right angle with respect to the engaging portion 32A. When the engaging portion 32A of the fixing terminal 32 is temporarily fixed to the fixing terminal holder 30 at the above-described regular mounting position, the lower-surface position of the soldering portion 32B in the vertical direction is formed so as to flush with the lower surface of the bottom plate 18.

Shielding walls 34 are formed integrally in each side wall 20 of the connector main body 14 or in the vicinity thereof in such a manner as to correspond to the fixing terminal 32. That is, two shielding walls 34 (a first shielding wall and a second shielding wall) are provided respectively at the front and rear sides of the soldering portion 32B of the fixing terminal 32 which is in a temporarily fixed state. The two shielding walls 34 extend to the opposite side of the side wall 20 (in a direction substantially perpendicular to the side wall 20 and outside from the side wall 20). Further, the two shielding walls 34 extend parallel to each other. The height-wise length of the shielding wall 34 (the height thereof in the direction perpendicular to the substrate) is longer than the plate thickness of the soldering portion 32B of the fixing terminal 32. The dimension of the shielding wall 34 in the leftward or rightward direction (the dimension thereof in the direction perpendicular to the side wall 20) is set such that the distal end of the shielding wall 34 in the direction in which it extends is located further at an outer side than the end of the soldering portion 32B which is in the temporarily fixed state.

Further, the shielding wall 34 is formed into a substantially triangle (trapezoid) when viewed from the side, and the height-wise length of the distal end of the shielding wall 34 is smaller than that of the basal end (at the side of the side wall 20) of the shielding wall 34.

In addition, the SMT connector 10 also includes a plurality of upper terminals 26 arranged in a line along the right-and-left direction, and a plurality of lower terminals 28 arranged in a line along the right-and-left direction. As shown in FIGS. 2A, 2B and 2C, no upper terminal 26 is provided at the central portion in the right-and-left direction, but the upper terminals 26 are provided directly above the lower terminals 28 other than the central portion in the right-and-left direction.

As shown in FIG. 2A, the upper terminals 26 and the lower terminals 28 are each made of metallic material such as wire material or streak-like material. The longitudinal direction of each terminal coincides with the front-to-back direction when viewed from the top, and each terminal passes through the backside wall 22 and projects backward from the rear side of the connector main body 14. In this way, the SMT connector 10 is formed as a male connector, and is connected to a female connector which is an external terminal in such a manner that the female connector is inserted from the opening portion 14A of the connector main body 14. In this connected state, the upper terminals 26 and the lower terminals 28, which are male terminals, are each connected in a conducting state by being inserted in an associated female terminal provided as an external terminal.

In the SMT connector 10 as described above, in the state in which the bottom plate 18 is placed on the substrate 12 with each positioning projection 24 being inserted in or passing through the positioning hole 12A of the substrate 12, the connector main body 14 is mounted on the substrate 12 with the soldering portion 32B of the fixing terminal 32, which is temporarily fixed to the fixing terminal 30 at the above-described regular mounting position, being soldered to the substrate 12. In this manner, the SMT connector 10 is mounted on the substrate 12 by soldering.

Next, the operation of the SMT connector 10 according to the embodiment of the present invention will be described.

The engaging portion 32A of the fixing terminal 32 is press-fitted into a notch portion (the notches) of the fixing terminal holder 30 of each side wall 20 of the connector main body 14 along the side wall 20 from the opposite side of the bottom plate 18 of the connector main body 14, that is to say, from the upper side.

When the engaging portion 32A of the fixing terminal 32 abuts against the stepped portion in the notch portion of the fixing terminal holder 30, the engaging portion 32A engages with the fixing terminal holder 30 and the fixing terminal 32 is temporarily fixed to the connector main body 14 at the regular mounting position.

Next, in the above-described temporarily fixed state, the bottom plate 18 of the connector main body 14 and the soldering portion 32B of the fixing terminal 32 are placed on the substrate 12. Subsequently, when the soldering portion 32B of the fixing terminal 32 is soldered to the substrate 12 in the above-described state, the stepped portion in the notch portion of the fixing terminal holder 30 is pushed down by the engaging portion 32A of the fixing terminal 32 toward the substrate 12. As a result, upward movement of the connector main body 14 is restricted, and the connector main body 14 is mounted on the substrate 12. That is to say, the SMT connector 10 is mounted on the substrate 12.

Here, in the SMT connector 10, even if excessive force is applied to the SMT connector 10 from outside for some reason (for example, when the SMT connector 10 is placed on the substrate 12, the SMT connector 10 is bumped against other electronic components placed on the substrate 12) during a time period from a time in which the engaging portion 32A of the fixing terminal 32 is press-fitted into the fixing terminal holder 30 of the connector main body 14 and the fixing terminal 32 is brought into a temporarily fixed state, until a time in which the bottom plate 18 of the connector main body 14 and the soldering portion 32B of the fixing terminal 32 are placed on the substrate 12, and further until a time in which the connector main body 14 is mounted on the substrate 12, the fixing terminal 32 is prevented from being interfered from outside due to the shielding walls 32 formed integrally with the connector main body 14 correspondingly to the fixing terminal 32. As a result, there is no possibility that the fixing terminal 32 be dislocated from a regular mounting position on the connector main body 14. In other words, this SMT connector 10 makes it possible to prevent the fixing terminal 32 from being removed from the fixing terminal holder 30 of the connector main body 14 or prevent the fixing terminal 32 from being placed on the substrate 12 in the state of having a space between the fixing terminal 32 and the substrate 12. Accordingly, when the soldering portion 32B of the fixing terminal 32 is soldered to the substrate 12, the connector main body 14 can be reliably mounted on the surface of the substrate 12.

As described above, the SMT connector 10 according to the embodiment of the present invention makes it possible to prevent the fixing terminal 32 from being dislocated from the regular mounting position on the connector main body 14 when excessive force is applied from outside before mounted on the substrate 12, and reliably perform surface-mounting of the connector main body 14 placed on the substrate 12, on the substrate 12.

What is claimed is:

1. A surface-mounted connector comprising:

a connector main body formed into a substantially rectangular box and to be placed on a substrate;

a fixing terminal having an engaging portion and a soldering portion, said terminal being temporarily fixed to a side wall of the connector main body by press-fitting said engaging portion, along the side wall, from a side opposite to that in which a bottom wall of the connector main body is placed on the substrate, and that, in the temporarily fixed state, the soldering portion is soldered to the substrate, thereby allowing the connector main body to be mounted on the substrate;

shielding walls provided integrally with the connector main body alongside the fixing terminal in the temporarily fixed state so as to correspond to the fixing terminal, and preventing the fixing terminal in the temporarily fixed state from being interfered from outside, and mechanical interference portions included in said engaging portions of said fixing terminal and said side wall of said connector main body that prevent said soldering portion from extending beyond said bottom wall of said connector main body during press-fitting and that limit upward movement of said connector main body away from said substrate after said soldering portion is soldered.

2. The surface-mounted connector according to claim 1, wherein the engaging portion is engaged and temporarily fixed at a predetermined position on the side wall, and said soldering portion is bent substantially perpendicular to the engaging portion and soldered to the substrate; and wherein the dimension of the shielding wall in a direction perpendicular to the substrate is greater than a plate thickness of the soldering portion.

3. The surface-mounted connector according to claim 1, wherein the engaging portion is engaged and temporarily fixed at a predetermined position on the side wall, and said soldering portion is bent substantially perpendicular to the engaging portion and soldered to the substrate;

wherein the shielding wall extends in a direction substantially perpendicular to the side wall, and in the temporarily fixed state, the soldering portion extends in a direction substantially perpendicular to the side wall; and in the temporarily fixed state, a distal end of the shielding wall in a direction it extends is located further at an outer side than a distal end of the soldering portion in a direction it extends.

4. The surface-mounted connector according to claim 1, wherein the engaging portion is engaged and temporarily fixed at a predetermined position on the side wall, and said soldering portion is bent substantially perpendicular to the engaging portion and soldered to the substrate;

wherein the shielding walls comprise a first shielding wall and a second shielding wall; and the first shielding wall and the second shielding wall extend from the side wall or from the vicinity thereof such that the soldering portion is interposed therebetween.

5. A surface-mounted connector according to claim 1, further comprising positioning projections insertable in holes in said substrate for positioning said connector main body relative to said substrate prior to said soldering.

6. A surface-mounted connector according to claim 1, wherein said mechanical interference portions include stepped portions in said press-fitted portions of said fixing terminal and said side wall of said connector main body.

7. A surface-mounted connector comprising:

a connector main body formed into a substantially rectangular box and to be placed on a substrate;

fixing terminals each including an engaging portion and a soldering portion that is bent substantially perpendicular to the engaging portion and soldered to the substrate, each of the fixing terminals being temporarily fixed to respective side walls of the connector main body by each engaging portion being press-fitted, along the respective side walls, from a side opposite to that in which a bottom wall of the connector main body is placed on the substrate, and, in the temporarily fixed state, each soldering portion being soldered to the substrate, thereby allowing the connector main body to be mounted on the substrate; and first shielding walls and second shielding walls provided integrally with the connector main body alongside the respective fixing terminals in the temporarily fixed state so as to correspond to the respective fixing terminals, and preventing the respective fixing terminals in the temporarily fixed state from being interfered from outside, wherein, at each of the side walls, the first shielding wall and the second shielding wall extend in a direction substantially perpendicular to the side wall, and in the temporarily fixed state, the soldering portion extends in a direction substantially perpendicular to the side wall, and the first shielding wall and the second shielding wall extend from the side wall or from the vicinity of the side wall such that the soldering portion is interposed therebetween, and mechanical interference portions between press-fitted portions of said fixing terminals and said side walls that prevent said soldering portion from extending beyond said bottom wall of said connector main body during press fitting, and that limit upward movement of said connector main body relative to said substrate.

8. The surface-mounted connector according to claim 7, wherein dimension of each of the first and second shielding walls in a direction perpendicular to the substrate is greater than a plate thickness of the soldering portion.

9. The surface-mounted connector according to claim 7, wherein in the temporarily fixed state, respective distal ends of the first and second shielding walls in a direction in which the first and second shielding walls extend is located further at an outer side than a distal end of the soldering portion in a direction in which it extends.

10. A surface-mounted connector according to claim 7, further comprising positioning projections insertable in holes in said substrate for positioning said connector main body relative to said substrate prior to said soldering.

11. A surface-mounted connector according to claim 7, wherein said mechanical interference portions include stepped portions in said press-fitted portions of said fixing terminal and said side wall of said connector main body.

12. A surface-mounted connector comprising:

a connector main body formed into a substantially rectangular box and to be placed on a substrate;

a fixing terminal that is temporarily fixed to a side wall of the connector main body by being press-fitted, along the side wall, from a side opposite to that in which the connector main body is placed on the substrate, and that, in the temporarily fixed state, is soldered to the substrate, thereby allowing the connector main body to be mounted on the substrate;

shielding walls provided integrally with the connector main body alongside the fixing terminal in the temporarily fixed state so as to correspond to the fixing terminal, and preventing the fixing terminal in the temporarily fixed state from being interfered from outside, and mechanical interference portions including stepped portions in said press-fitted portions of said fixing terminal and said side wall of said connector main body that limit upward movement of said connector main body away from said substrate.

* * * * *